US007387559B2

(12) United States Patent
Sanchez-Castro et al.

(10) Patent No.: US 7,387,559 B2
(45) Date of Patent: Jun. 17, 2008

(54) TOY VEHICLES AND PLAY SETS WITH CONTACTLESS IDENTIFICATION

(75) Inventors: Jorge Sanchez-Castro, Downey, CA (US); Robert Grzesek, Redondo Beach, CA (US); Nicholas Amireh, Los Angeles, CA (US); Darin Barri, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 74 days.

(21) Appl. No.: 10/989,837

(22) Filed: Nov. 15, 2004

(65) Prior Publication Data

US 2005/0148281 A1 Jul. 7, 2005

Related U.S. Application Data

(60) Provisional application No. 60/523,158, filed on Nov. 17, 2003, provisional application No. 60/543,449, filed on Feb. 9, 2004.

(51) Int. Cl.
*A63H 29/00* (2006.01)

(52) U.S. Cl. ..... 446/444; 446/433

(58) Field of Classification Search ..... 446/444, 446/433

See application file for complete search history.

(56) References Cited

U.S. PATENT DOCUMENTS 3,124,902 A * 3/1964 Gowland et al. ..... 446/455
3,510,631 A 5/1970 Weinberg et al.
3,531,118 A 9/1970 Mabie et al.
3,572,711 A 3/1971 Conklin et al.
3,729,193 A 4/1973 Labis
3,926,434 A 12/1975 Cannon, Jr.
3,946,312 A 3/1976 Oswald et al.
4,001,822 A 1/1977 Sterzer
4,242,663 A 12/1980 Slobodin
4,247,107 A 1/1981 Smith, III et al.
4,330,127 A 5/1982 Brand et al.
4,364,566 A 12/1982 Neuhierl
4,459,438 A 7/1984 Kaiser
4,857,886 A 8/1989 Crews
4,925,188 A * 5/1990 McKay et al. ..... 446/444
4,999,604 A 3/1991 Crews (Continued)

FOREIGN PATENT DOCUMENTS

EP 0045490 A 2/1982

(Continued)

OTHER PUBLICATIONS

European Search Report from corresponding European Application No. EP04811171, dated Oct. 23, 2007.

*Primary Examiner*—Yaritza Guadalupe-McCall
(74) *Attorney, Agent, or Firm*—Kolisch Hartwell, P.C.

(57) ABSTRACT

Toy vehicle sets may include a toy vehicle with an RFID transponder operable to produce an identification signal to identify the toy vehicle and an RFID reader configured to generate an electromagnetic field, detect an identification signal produced by an RFID transponder, and produce data representative of the identified toy vehicle. In some embodiments, the toy vehicle includes circuitry adapted to convert electromagnetic energy into power to operate the RFID transponder. In some embodiments, the toy vehicle includes a metal chassis with an aperture configured to support the RFID transponder and a transverse slot cut from an outer edge of the chassis to the aperture.

15 Claims, 2 Drawing Sheets

U.S. PATENT DOCUMENTS

| | | | | |
|---|---|---|---|---|
| 5,090,030 | A | 2/1992 | Jenkins | |
| 5,125,010 | A | 6/1992 | Lee et al. | |
| 5,173,856 | A | 12/1992 | Purnell et al. | |
| 5,194,843 | A | 3/1993 | Jones et al. | |
| 5,299,969 | A | 4/1994 | Zaruba | |
| 5,367,286 | A | 11/1994 | Voillat | |
| 5,420,903 | A | 5/1995 | Newton | |
| 5,435,553 | A | 7/1995 | Arima et al. | |
| 5,542,668 | A | 8/1996 | Casale et al. | |
| 5,661,470 | A | 8/1997 | Karr | |
| 5,666,101 | A | 9/1997 | Cazzani et al. | |
| 5,676,586 | A | 10/1997 | James | |
| 5,749,547 | A | 5/1998 | Young et al. | |
| 5,823,782 | A | 10/1998 | Marcus et al. | |
| 5,853,327 | A | 12/1998 | Gilboa | |
| 5,970,882 | A | 10/1999 | Smith et al. | |
| 6,089,951 | A | 7/2000 | Ostendorff | |
| 6,109,186 | A | 8/2000 | Smith et al. | |
| 6,192,099 | B1 | 2/2001 | Chiu | |
| 6,491,566 | B2 * | 12/2002 | Peters et al. | 446/454 |
| 6,709,336 | B2 | 3/2004 | Siegel et al. | |
| 6,761,637 | B2 | 7/2004 | Weston et al. | |
| 6,905,391 | B2 * | 6/2005 | Soto et al. | 446/397 |
| 6,937,152 | B2 * | 8/2005 | Small | 446/297 |
| 6,965,298 | B2 * | 11/2005 | Feinberg | 446/175 |
| 6,967,566 | B2 | 11/2005 | Weston et al. | |
| 7,081,033 | B1 | 7/2006 | Mawle et al. | |
| 2002/0052238 | A1 | 5/2002 | Muroi | |
| 2002/0068528 | A1 | 6/2002 | White et al. | |
| 2002/0132553 | A1 * | 9/2002 | Jelinek | 446/268 |
| 2002/0193047 | A1 * | 12/2002 | Weston | 446/484 |
| 2003/0148698 | A1 * | 8/2003 | Koenig | 446/15 |
| 2003/0186739 | A1 * | 10/2003 | Paulsen et al. | 463/25 |
| 2004/0152521 | A1 | 8/2004 | Shinoda | |
| 2004/0166913 | A1 | 8/2004 | Shinoda | |
| 2004/0214642 | A1 * | 10/2004 | Beck | 463/40 |
| 2004/0259465 | A1 * | 12/2004 | Wright et al. | 446/297 |
| 2005/0070204 | A1 * | 3/2005 | McEachen et al. | 446/297 |
| 2005/0164601 | A1 * | 7/2005 | McEachen et al. | 446/456 |
| 2006/0031119 | A1 | 2/2006 | Sellen et al. | |

FOREIGN PATENT DOCUMENTS

| | | |
|---|---|---|
| JP | 2003-047771 | 2/2003 |
| WO | WO 02/47013 A2 | 6/2002 |
| WO | WO 2006/036851 A2 | 4/2006 |
| WO | WO 2006/038905 A1 | 4/2006 |

* cited by examiner

TOY VEHICLES AND PLAY SETS WITH CONTACTLESS IDENTIFICATION

RELATED APPLICATIONS

This application is based upon and claims priority under 35 U.S.C. § 119(e) to the U.S. Provisional Patent Application No. 60/523,158 filed on Nov. 17, 2003 and U.S. Provisional Patent Application No. 60/543,449 filed on Feb. 9, 2004, which are incorporated herein by reference in their entirety for all purposes.

TECHNICAL FIELD

The present disclosure relates generally to toy vehicles and play sets for use with toy vehicles, and more particularly to toy vehicle play sets that include a track and a contactless identification system to identify toy vehicles traversing the track.

BACKGROUND

Tracks for toy cars and other vehicles may be used to set up play towns, cities, highways, race courses, and other play settings for the vehicles, such as to provide entertainment and challenges to players. Some tracks may be arranged in a closed circuit, such as to form a race course for the vehicles to repeatedly traverse. Such track setups may include features to track the number of laps traversed by a toy vehicle, for example, by incrementing a displayed lap count in response to a mechanical switch triggered by a toy vehicle traveling over a specially configured section of track. However, such track setups are limited in terms of the ability of the track components to distinguish among a plurality of toy vehicles that may be traversing a track.

Examples of toy cars and tracks for use therewith are found in U.S. Pat. Nos. 3,572,711, 4,330,127, 4,364,566, 5,125,010, 6,089,951, and 6,109,186. Examples of systems of recording race objects in various settings are found in U.S. Pat. Nos. 3,531,118, 3,946,312, 5,173,856, 5,194,843, 5,420,903, 5,970,882, and 6,192,099. All of the aforementioned disclosures are incorporated by reference in their entirety for all purposes.

SUMMARY

The present disclosure is directed to play sets including toy vehicles, such as toy racecars, and a track. The track may include a toy vehicle guiding pathway that may be arranged to resemble a race course, which the toy cars or other vehicles may traverse. The track may also include one or more contactless interrogation devices, such as sensors, transmitters, and/or RFID readers, which may be configured to register the passing of a toy vehicle or vehicles at one or more predetermined points along the pathway. Further, each toy vehicle may include an identification device, such as an RFID transponder, operable to produce an identification signal to identify the toy vehicle.

In some embodiments, one or more RFID readers are each placed beneath the track or otherwise disposed to generate a corresponding interrogation zone that overlaps a predetermined section of the pathway, and the toy vehicles are each configured to support an RFID transponder at or near a bottom surface of the toy vehicle. Such a configuration may allow the readers to identify toy vehicles as they traverse the pathway or otherwise engage the interrogation zones generated by the readers. Some embodiments further include a processor responsive to one or more RFID readers and coupled to one or more downstream components such as a display, a speaker, etc. Such configurations may allow processor control of play-related functions of the components based on data from the RFID readers as they identify toy vehicles traversing the track.

In some embodiments, the toy vehicles include circuitry associated with the RFID transponder, which is configured to rectify energy emitted by the RFID readers, such as to provide power to operate the transponder to produce an identification signal, to provide motive force for the toy vehicle, and so forth. In some embodiments, each toy vehicle includes a metal chassis with an aperture adapted to support an RFID transponder, and a transverse slot cut from an outer edge of the chassis to the aperture. Such a slot may prevent eddy currents from being induced in the metal chassis during RF data transfer between the transponder and the readers.

DETAILED DESCRIPTION

Automatic identification procedures using contactless technology have been developed to provide information about items in transit. An item may be supplied with an electronic data-carrying device, which transfers data about the item, such as the identity of the item, to and from a reading device. In some contactless systems, such as radio frequency identification (RFID) systems, the power to operate the electronic data-carrying device may be supplied by the reading device.

An RFID system may include a transponder, which is located on the item or object to be identified, and an interrogator or reader, which may be a read or write/read device. The reader typically contains a radio frequency module (transmitter and receiver), a control unit, and a coupling element, such as an antenna or coil. The transponder, which represents the data-carrying device of an RFID system, typically consists of a coupling element and an electronic microchip. A transponder may also be equipped with its own voltage supply, such as a battery. However, a "passive" transponder may instead have circuitry configured to activate only when the transponder is within the interrogation zone of a reader. Thus, transponders may be incorporated into any suitable size and/or design, depending on the application, and may be miniaturized, such as by integrating a coil directly onto a chip.

One type of RFID system operates when the reader generates a electromagnetic alternating field in the radio frequency range. If a passive transponder is moved into the vicinity of the field, a voltage is generated in the transponder's coil by inductance. This voltage may be rectified in the transponder's circuitry to serve as the power supply for the microchip, which may prompt the transponder's coil to emit an identification signal in response. Readers may be configured to resolve several simultaneously received identification signals, allowing a reader to be used with, and distinguish among, several transponders. Readers may also be adapted to generate a field of any desired size and/or intensity, such as by varying the configuration of the coil.

Figure 1:
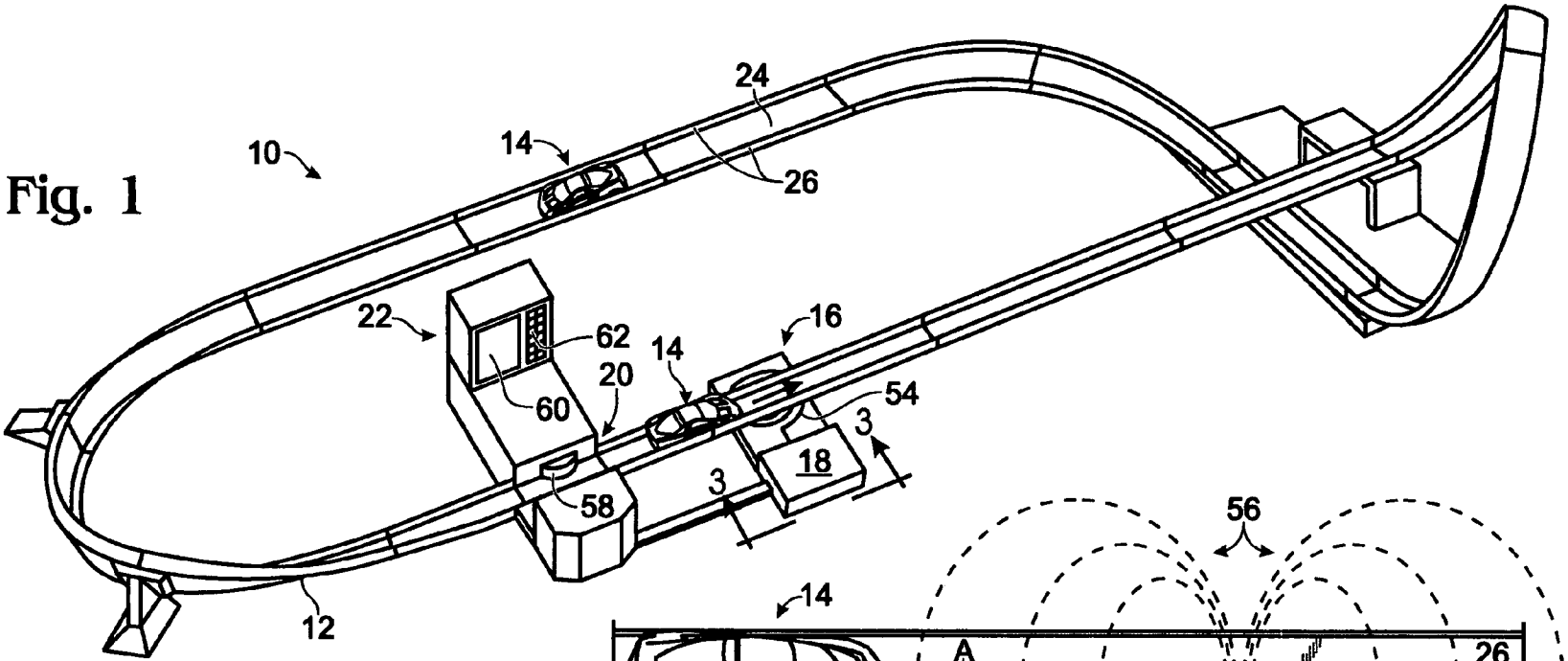
FIG. 1 shows an exemplary toy vehicle play set that includes a toy racecar, a track, an RFID reader, a housing, a booster device, and an output device.

Some embodiments of toy vehicle play sets according to the present disclosure include toy vehicles with RFID transponders and a track with one or more RFID readers. An exemplary embodiment of such a toy vehicle play set 10 is shown in FIG. 1 to include a track 12, toy vehicles 14 traversing the track, an RFID reader 16, a processor 18, a booster device 20, and an output device 22.

Track 12 includes a toy vehicle guiding pathway 24, which is bounded by stops or rails 26 to constrain the movement of toy vehicle 14 to a longitudinal direction along the pathway between rails 26. Track 14 may be provided in a series of connectable segments of extruded or molded plastic or other material, or may be formed in a single integral piece. As shown, track 12 is arranged in a closed circuit and includes a vertically disposed loop, and pathway 24 is wide enough to accommodate one toy vehicle 14. However, other configurations of track 12 may include additional loops, turns, or other features, such as to enhance play value, and the width of pathway 24 may be adapted to accommodate any number of toy vehicles. A pathway wide enough to accommodate more than one toy vehicle may be subdivided with additional rails into individual lanes, or may consist wholly or in part of one lane wide enough to accommodate two or more toy vehicles side-by-side.

Figure 2:
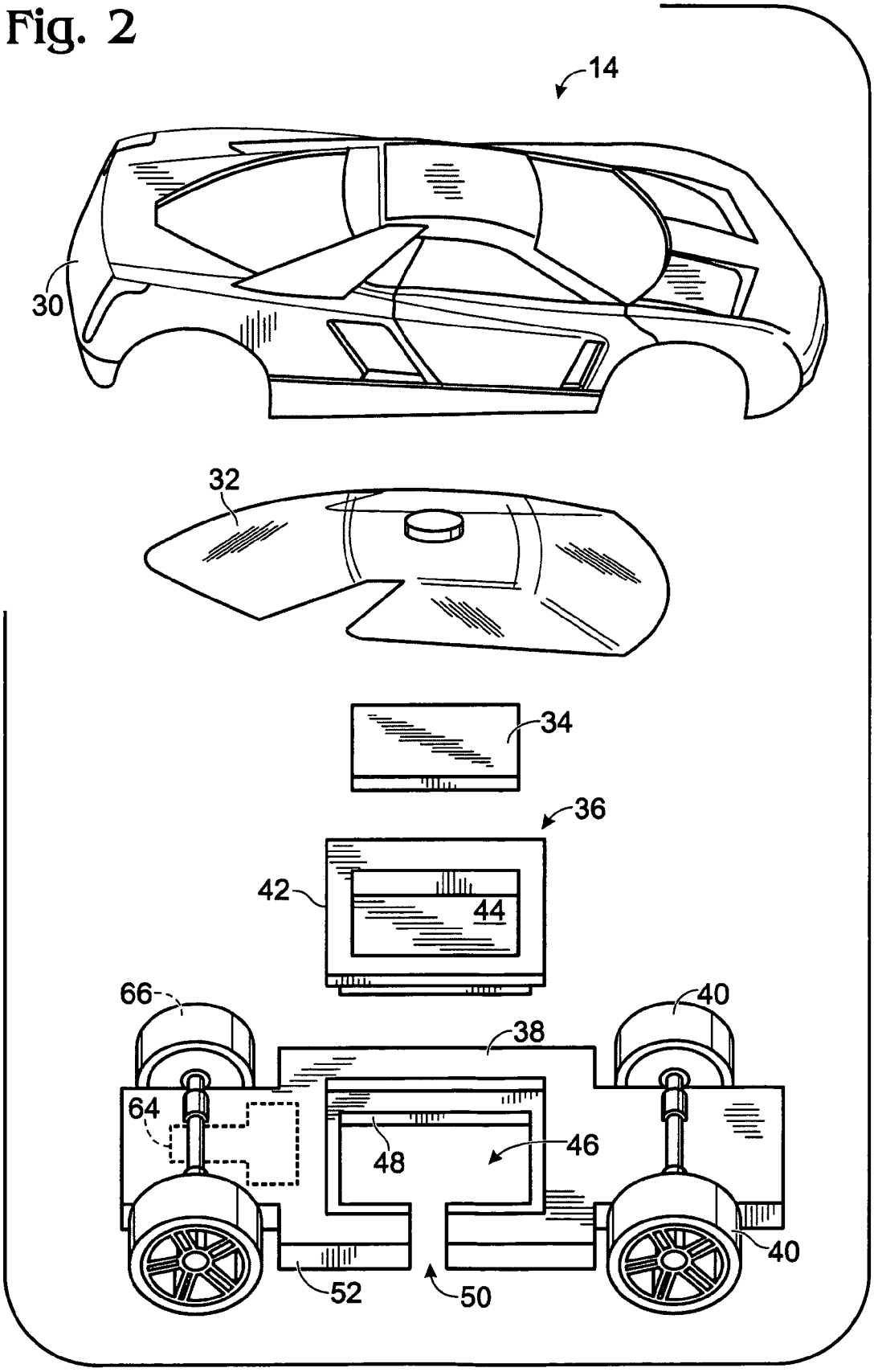
FIG. 2 is an exploded view showing components of the toy racecar of FIG. 1, including a chassis, a support, an RFID transponder, a window insert, and a body portion.

An exemplary toy vehicle 14 is shown in FIG. 2 to be assembled of several component parts, including a body 30, a window insert 32, an RFID transponder 34, a support 36, a chassis 38, and a plurality of wheels 40. Body 30 is shaped to resemble a race car, but may be adapted to have any desired vehicle shape. Window insert 32 is formed of plastic, and is adapted to fit securely within body 30 to collectively simulate the exterior appearance of a vehicle. RFID transponder 34 is shown as a square-shaped wafer, and is operable to produce an identification signal to identify toy vehicle 14. Transponder 34 thus may be used to provide a unique identity for toy vehicle 14 that can be identified by RFID reader 16, for use in various play scenarios using play set 10, as described in greater detail below.

Support 36 resembles a tray, and includes a flanged periphery 42 surrounding a recessed surface 44 that is sized and shaped to receive RFID transponder 34. Chassis 38 includes an aperture 46 bounded by a stepped inner edge 48 that is sized and shaped to receive support 36, thus securing RFID transponder 34 relative to the chassis. Chassis 38 further includes a transverse slot 50 extending from an outer edge 52 to inner edge 48. Body 30 is adapted to fit together and interlock with chassis 38, and wheels 40 support toy vehicle 14.

In the illustrated embodiment, chassis 38 is formed of die cast metal and support 36 is fabricated from a non-conductive and/or non-magnetic material such as plastic. RFID transponder 34 and chassis 38 are roughly equidistant from a surface upon which the toy vehicle is placed, such as pathway 24, spaced from the pathway by wheels 40. An electromagnetic magnetic field generated at or near the pathway, such as by an RFID reader placed under the track upon which the toy vehicle moves, may induce interfering eddy currents in a metal chassis. This interference in turn may impede the operation of an RFID transponder. Providing chassis 38 with slot 50 circumvents any such interference, and thus may allow more accurate data transfer between an RFID transponder positioned in the toy vehicle and an RFID reader.

Figure 3:
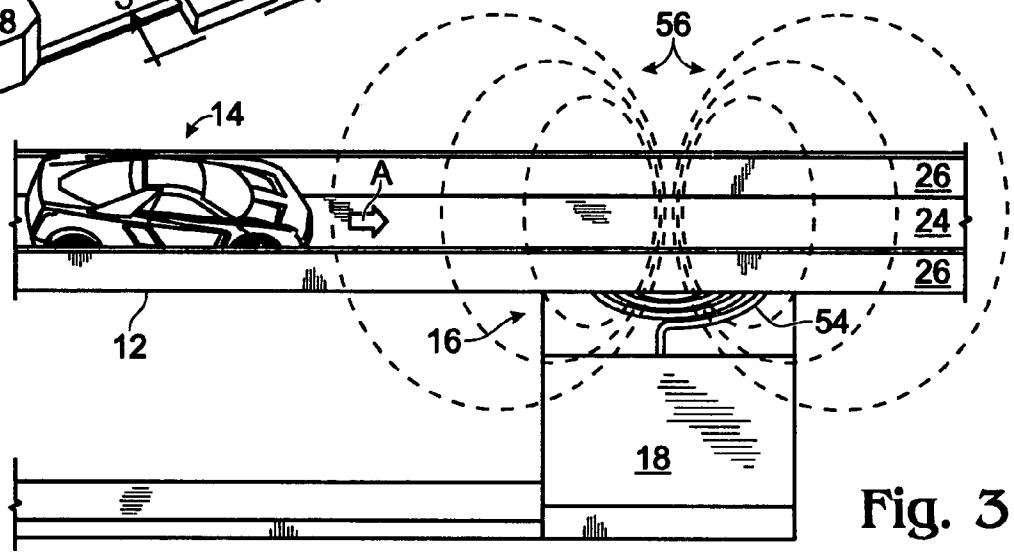
FIG. 3 is a detail view of a portion of the toy racecar, track and RFID reader along the line 3-3 of FIG. 1, and also schematically represents a portion of an electromagnetic field generated by the RFID reader.

With reference to FIGS. 1 and 3, RFID reader 16 is shown positioned underneath track 12, and includes a sensor coil 54 and associated circuitry (not separately shown) for generating an electromagnetic field via coil 54. RFID reader 16 is configured to generate an electromagnetic field, detect an identification signal produced by an RFID transponder within the field, and produce data representative of the toy vehicle that includes the RFID transponder. More particularly, and with reference to FIG. 3, RFID reader 16 generates an electromagnetic field 56, schematically indicated with dashed lines, that overlaps a portion of pathway 24. Thus, toy vehicle 14 traversing pathway 24 in the direction indicated by arrow A will engage electromagnetic field 56, at which point the vehicle's RFID transponder will produce an identification signal to identify the toy vehicle and the signal will be detected by the RFID reader.

In the illustrated embodiment, play set 10 includes only one RFID reader 16. However, alternate embodiments may contain two or more readers placed at predetermined points along track 14 and interconnected by a processor such as processor 18. Also, characteristics of electromagnetic field 56 such as size, shape, and intensity, may be varied in some embodiments, depending on the configuration of the RFID reader or readers. For example, an elongate sensor coil extending below or otherwise along a predetermined length of track may generate a correspondingly elongate electromagnetic field. Since a toy vehicle traversing a track at a given velocity will engage an elongate field for a longer duration than a shorter field, an elongate sensor coil may aid an RFID reader in accurately detecting one or more RFID transponders simultaneously engaging the field, allow a more accurate determination of a toy vehicle's velocity, and so forth.

RFID reader 16 is shown in FIG. 1 to be coupled to processor 18, which is configured to process data produced by the RFID reader and to control downstream components of play set 10. For example, processor 18 may be configured to calculate the velocity of identified toy vehicles based on data from one or more RFID readers, and/or perform other calculations. Optionally, processor 18 may control booster device 20, shown in FIG. 1 to include a pair of opposed, circular, rotating bumpers 58 disposed relative to pathway 24 to engage a toy vehicle passing through the booster device, such as to impart a velocity change to an identified toy vehicle. Processor 18 may also control output device 22, shown in FIG. 1 to include a visual readout such as display 60, and a speaker 62. Output device 22 may emit one or more report signals via the speaker and/or the display, based on toy vehicles identified by one or more RFID readers.

A toy vehicle play set provided with the foregoing components and RFID system may allow for a wide variety of possible play patterns, displays, and controls. For example, the toy vehicle's progress around the track may be monitored by one or more RFID readers, and various race parameters may be recorded, processed, and displayed on the output device. Such parameters may include the number of laps around the track traversed by one or more toy vehicles, the current and/or average speed of each toy vehicle, the position of each toy vehicle on the pathway, and so forth.

Some play patterns may involve processor control of downstream play set components based on one or more parameters of an identified toy vehicle. For example, processor 16 may rotate bumpers 58 of booster device 20 at a predetermined rotational speed based on the determined velocity of an identified toy vehicle, such as to impart a velocity change to the vehicle as it passes through booster device 20. Processor 16 may track the relative positions of several toy vehicles in a race, determine a winner, and prompt output device 22 to emit a variety of corresponding visual and/or aural report signals.

Further, some play sets may include other components to allow other play patterns, or to augment play patterns herein described. For example, a play set may be provided with a memory and one or more input devices, such as to allow users to track and review parameters and other records for each vehicle. A play set may also include a variety of lights or other visual displays, speakers, or other output devices to emit signals and reports in response to the identification and tracking of toy vehicles traversing the track, for example by flashing a light, emitting a horn or engine sound effect, or prompting other lighting or sound effects to indicate the completion of a race.

Optionally, in some play sets, a motive force for the toy vehicles may be provided by means in addition to, or instead of, a booster device. For example, a starting end of a pathway may be higher than a finishing end, providing a gravity feed for a toy vehicle. In some embodiments, a toy vehicle may include a motor or circuitry to drive one or more driven wheels of the toy vehicle. An electrical current to provide power to the driven wheel or wheels may be provided through a slot in the pathway, an on-board battery, or through the use of RF energy, such as from RFID reader 16. For example, toy vehicle 14 may include additional drive circuitry 64 (indicated in dashed lines in FIG. 2) configured to rectify voltage induced in the RFID transponder into power to drive a driven wheel (indicated as 66).

Other characteristics or components of toy vehicle 14 are possible and are within the scope of this disclosure. For example, the illustrated toy vehicle in FIG. 2 includes window insert 32 and body 30 that are fabricated from plastic. However, such structural components may optionally be fabricated from conductive and/or magnetic materials. For example, a body fabricated from metal and suspended over an RFID transponder physically may be sufficiently distant from an RFID reader placed under a track (as shown in FIGS. 1 and 3), that the electromagnetic field generated by the RFID reader may not be subject to any interference caused by a current induced in a metal body. Such interference may optionally be circumvented by fabricating a metal body in a manner as detailed above with respect to chassis 38, that is, by including a slot or similar gap in the metal. Optionally, interference may be avoided in other manners. For example, components of toy vehicle 14 may include non-conductive and/or non-magnetic materials. In some embodiments, all of the structural components of toy vehicle 14 may be fabricated from plastic or one or more other non-conductive and/or non-magnetic materials. In some embodiments, the intensity, shape, or other characteristic of the electromagnetic field generated by an RFID reader may be adjusted so that data transfer between the reader and a transponder is not affected by distant interference fields.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element of the equivalent thereof, such claims should be understood to include incorporation of one or more such elements, neither requiring nor excluding two or more such elements.

It is believed that the following claims particularly point out certain combinations and subcombinations of features, functions, elements and/or properties that may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

What is claimed is:

1. A toy vehicle set comprising:

a toy vehicle including an RFID transponder operable to produce an identification signal to identify the toy vehicle and a chassis configured to support the RFID transponder within the toy vehicle, the chassis being at least partially fabricated from a material that is one or more of conductive and magnetic;

an RFID reader configured to:

generate an electromagnetic field;

detect an identification signal produced by an RFID transponder; and produce data representative of the identified toy vehicle; and a track with a toy vehicle guiding pathway, wherein the RFID reader is disposed along the pathway such that a toy vehicle traversing the pathway engages the electromagnetic field;

wherein the chassis is configured to prevent interference with the electromagnetic field generated by the RFID reader.

2. The toy vehicle set of claim 1 wherein the toy vehicle further includes circuitry associated with the RFID transponder, such that the circuitry is adapted, upon engaging the electromagnetic field, to convert electromagnetic energy into power to operate the RFID transponder.

3. The toy vehicle set of claim 1 wherein the toy vehicle further includes circuitry associated with the RFID transponder, such that the circuitry is adapted, upon engaging the electromagnetic field, to convert electromagnetic energy into power to provide motive force to the toy vehicle.

4. The toy vehicle set of claim 3 wherein the toy vehicle further includes a plurality of wheels, including at least one driven wheel, and wherein the converted power is adapted to drive the at least one driven wheel of the toy vehicle.

5. The toy vehicle set of claim 1 wherein the chassis further includes:

an outer edge;

an aperture defined by an inner edge; and a transverse slot from the outer edge to the inner edge.

6. The toy vehicle set of claim 1 further including a processor responsive to the RFID reader and configured to process data produced by the RFID reader.

7. The toy vehicle set of claim 6, further including an output device responsive to the processor and configured to emit one or more report signals when the RFID reader produces data representative of an identified toy vehicle.

8. The toy vehicle set of claim 6 wherein the processor is configured to calculate the velocity of an identified toy vehicle.

9. The toy vehicle set of claim 8 wherein the pathway further includes a booster device responsive to the processor and configured to impart a velocity change to an identified toy vehicle as it passes the booster device, wherein the velocity change is based at least in part on the velocity of the identified toy vehicle as calculated by the processor.

10. A toy vehicle comprising:

an RFID transponder; and a chassis defined by an outer edge and at least partially fabricated from a material that is one or more of conductive and magnetic, the chassis further including:

an aperture defined by an inner edge, the aperture configured to support the RFID transponder; and a transverse slot from the outer edge to the inner edge of the aperture.

11. The toy vehicle of claim 10, further including a plurality of wheels adapted to support the chassis on a ground surface.

12. The toy vehicle of claim 10, further including a support sized to receive the RFID transponder and fit substantially within the aperture.

13. A toy vehicle set comprising:

a toy vehicle including an RFID transponder operable to produce an identification signal to identify the toy vehicle;

an RFID reader configured to:

generate an electromagnetic field;

detect an identification signal produced by an RFID transponder; and produce data representative of the identified toy vehicle;

wherein the toy vehicle further includes circuitry associated with the RFID transponder, such that the circuitry is adapted, upon engaging the electromagnetic field, to convert electromagnetic energy into power to provide motive force to the toy vehicle.

14. The toy vehicle set of claim 13 wherein the toy vehicle further includes a plurality of wheels, including at least one driven wheel, and wherein the converted power is adapted to drive the at least one driven wheel of the toy vehicle.

15. The toy vehicle set of claim 13, further including:

a processor responsive to the RFID reader and being configured to process data produced by the RFID reader and to calculate the velocity of an identified toy vehicle;

a track with a toy vehicle guiding pathway, wherein the RFID reader is disposed along the pathway such that a toy vehicle traversing the pathway engages the electromagnetic field; and a booster device disposed along the track, the booster device configured to respond to the processor and to impart a velocity change to an identified toy vehicle as it passes the booster device, wherein the velocity change is based at least in part on the velocity of the identified toy vehicle as calculated by the processor.

* * * * *